US007967508B2

(12) United States Patent
Costello

(10) Patent No.: US 7,967,508 B2
(45) **Date of Patent: *Jun. 28, 2011**

(54) LEAF COLLECTION APPARATUS

(76) Inventor: Steven D. Costello, Elkins Park, PA (US)

( * ) Notice: Subject to any disclaimer, the term of this patent is extended or adjusted under 35 U.S.C. 154(b) by 48 days.

This patent is subject to a terminal disclaimer.

(21) Appl. No.: 12/370,181

(22) Filed: Feb. 12, 2009

(65) Prior Publication Data

US 2009/0154847 A1 Jun. 18, 2009

Related U.S. Application Data

(63) Continuation of application No. 10/898,758, filed on Jul. 26, 2004, now Pat. No. 7,594,754.

(51) Int. Cl.
*B65D 30/00* (2006.01)

(52) U.S. Cl. ..... 383/4; 363/72; 363/119; 43/12

(58) Field of Classification Search ..... 383/4, 72, 383/119; 43/12

See application file for complete search history.

(56) References Cited

U.S. PATENT DOCUMENTS

| | | | |
|---|---|---|---|
| 403,928 | A | 5/1889 | Emeric |
| 1,871,101 | A | 12/1931 | Waltz |
| 2,587,770 | A | 3/1952 | Schatz |
| 2,766,797 | A | 7/1955 | Cowen |
| 2,749,695 | A | 6/1956 | Hoppingarner |
| 2,749,957 | A | 6/1956 | Smith |
| 2,974,971 | A | 3/1961 | Buck |
| 3,011,820 | A | 12/1961 | Frieder et al. |
| 3,490,216 | A | 1/1970 | Gonzalez |
| 3,626,900 | A | 12/1971 | Failla |
| 4,296,788 | A | 10/1981 | Slater |
| 4,337,812 | A | 7/1982 | Trinkner |
| 4,366,949 | A | 1/1983 | Staub, Sr. |
| 4,561,480 | A | 12/1985 | Underwood et al. |
| 4,580,372 | A | 4/1986 | Osborn |
| D291,133 | S | 7/1987 | Disanza |
| 4,682,447 | A | 7/1987 | Osborn |
| 4,794,029 | A | 12/1988 | Tennant et al. |

(Continued)

OTHER PUBLICATIONS

Lawn and Leaf Tarp, Plow & Hearth Online Catalog, http://www.plowhearth.com/product.asp?section_id=0&department=0&search_type=normal&search_value=50055&pcode=7793, Jul. 26, 2004.

(Continued)

*Primary Examiner* — Justin M Larson
*Assistant Examiner* — Peter Helvey
(74) *Attorney, Agent, or Firm* — K&L Gates LLP

(57) ABSTRACT

The present invention is directed to an apparatus for collecting fallen leaves or other objects. According to various embodiments, the apparatus comprises a mesh, central collection section for lying flat on the ground such that objects may be accumulated onto an upper side of an interior portion of the central collection section. The apparatus also includes an enclosure system connected to the central collection section such that an operator can enclose a peripheral portion of the central collection section around the interior portion. In that way, the objects accumulated onto the central collection section can be easily transported and subsequently emptied. The apparatus may also comprise a plurality of stiffeners connected to a lower side of the peripheral portion of the central collection section. The stiffeners may extend inward from an outer edge of the central collection apparatus and may be made of plastic. In addition, the enclosure system may comprise a plurality of grommets connected to the peripheral portion of the central collection section, a rope passing through eyelets of the grommets, and a handle connected to the rope.

13 Claims, 1 Drawing Sheet

U.S. PATENT DOCUMENTS

| | | | | |
|---|---|---|---|---|
| 4,799,520 | A | | 1/1989 | Blackburn et al. |
| 4,895,742 | A | | 1/1990 | Schaub et al. |
| 4,901,513 | A | | 2/1990 | Kim et al. |
| 4,938,607 | A | | 7/1990 | Kelley |
| 4,955,068 | A | | 9/1990 | Tennihan |
| 5,066,143 | A | | 11/1991 | Sanders |
| D327,345 | S | | 6/1992 | Lammon et al. |
| D331,864 | S | | 12/1992 | Sciubba |
| 5,178,426 | A | | 1/1993 | David et al. |
| 5,222,988 | A | * | 6/1993 | Riley |
| 5,289,670 | A | * | 3/1994 | Morgan et al. |
| D349,593 | S | * | 8/1994 | Hensley |
| 5,364,188 | A | * | 11/1994 | Godfried et al. |
| RE34,849 | E | * | 2/1995 | Sanders |
| 5,417,462 | A | * | 5/1995 | Hensley |
| 5,518,313 | A | * | 5/1996 | McAdam |
| 5,579,610 | A | * | 12/1996 | Jackson |
| 5,580,635 | A | * | 12/1996 | Hoheisel |
| 5,664,886 | A | * | 9/1997 | Hutchinson |
| D386,865 | S | * | 11/1997 | Storm |
| 5,722,220 | A | * | 3/1998 | Greenland |
| RE36,775 | E | * | 7/2000 | Hoheisel |
| 6,267,504 | B1 | * | 7/2001 | Screen |
| 6,739,754 | B2 | * | 5/2004 | Moor et al. |
| 6,932,510 | B2 | * | 8/2005 | Sway et al. |
| 2006/0018568 | A1 | * | 1/2006 | Costello |

OTHER PUBLICATIONS

Landscaper Bag, Plow & Hearth Online Catalog, http://www.plowhearth.com/product.asp?pcode=6106&crs=6108&ref= product, Feb. 5, 2008.

Garden Tarp, Plow & Hearth Online Catalog, http://www.plowhearth.com/product.asp?section_id=2008&search_type= featured&search_v..., Feb. 5, 2008.

* cited by examiner

LEAF COLLECTION APPARATUS

This application is a continuation of co-pending application Ser. No. 10/898,758, filed Jul. 26, 2004, which is incorporated herein in its entirety.

BACKGROUND

During autumn in many communities, homeowners must haul fallen leaves to the street curb in order that the local municipality may collect the leaves. For homeowners with large property and/or a great number of deciduous trees on the property (and correspondingly a great number of fallen leaves), this can be a time-consuming and burdensome task.

One known solution to ease this burden is to use a pickup cloth or bag. As such, the leaves are either raked onto the pickup cloth or into the bag, and then the cloth/bag is hauled to the street curb where it is emptied. Pickup cloths, however, are not ordinarily designed to close in a fashion that prevents leaves from falling out during the closing up of the pickup cloth or the subsequent transportation of the pickup cloth to the street curb. Also, pickup clothes are not ordinarily resistant to wind. Consequently, gusts of winds can prevent the person performing the raking from successfully positioning the pickup cloth flat on the ground in the first place.

The difficulties with using garbage bags to haul fallen leaves are different, but equally frustrating. In particular, it is time-consuming and burdensome to rake a great number of leaves into the small opening of a garbage bag. Also, garbage bags are susceptible to tears, which in some circumstances may allow leaves, previously placed in the bag, to escape the confines of the bag, thereby causing the person performing the raking to have to redo some work.

SUMMARY OF THE INVENTION

In one general aspect, the present invention is directed to a leaf collection apparatus. According to various embodiments, the leaf collection apparatus comprises a mesh, central collection section for lying flat on the ground such that objects may be accumulated onto an upper side of an interior portion of the central collection section. The apparatus also includes an enclosure system connected to the central collection section such that an operator can enclose a peripheral portion of the central collection section around the interior portion. In that way, the objects (e.g., fallen leaves) accumulated onto the central collection section can be easily transported and subsequently emptied.

According to various implementations, the leaf collection apparatus may also comprise a plurality of stiffeners connected to a lower side of the peripheral portion of the central collection section. The stiffeners may extend inward from an outer edge of the central collection apparatus and may be made of plastic. In addition, the enclosure system may comprise a plurality of grommets connected to the peripheral portion of the central collection section, a rope passing through eyelets of the grommets, and a handle connected to the rope. In order to close the central collection section around the leaves or other objects accumulated on the upper side of the central collection section, the operator simply needs to pull the rope via the handle to cinch up the central collection section around the leaves/objects.

Also, the interior portion of the central collection section may be made of a different material and/or may be thicker than the peripheral portion of the central collection section. Additionally, the central collection section may comprise a polyethylene monofilament knitted mesh.

Various embodiments of the present invention provide important advantages over prior art leaf collection apparatuses. For one, use of a mesh central collection section reduces the effect of wind on positioning the central collection section flat on the ground. Also, the stiffeners may make the apparatus easier to close in comparison with prior art leaf collection apparatuses. The impact of this advantage is increased when a large central collection section is used (which permits a large quantity and/or load of leaves/objects to be collected). These and other benefits will be apparent from the description below.

DETAILED DESCRIPTION OF THE INVENTION

Figure 1:
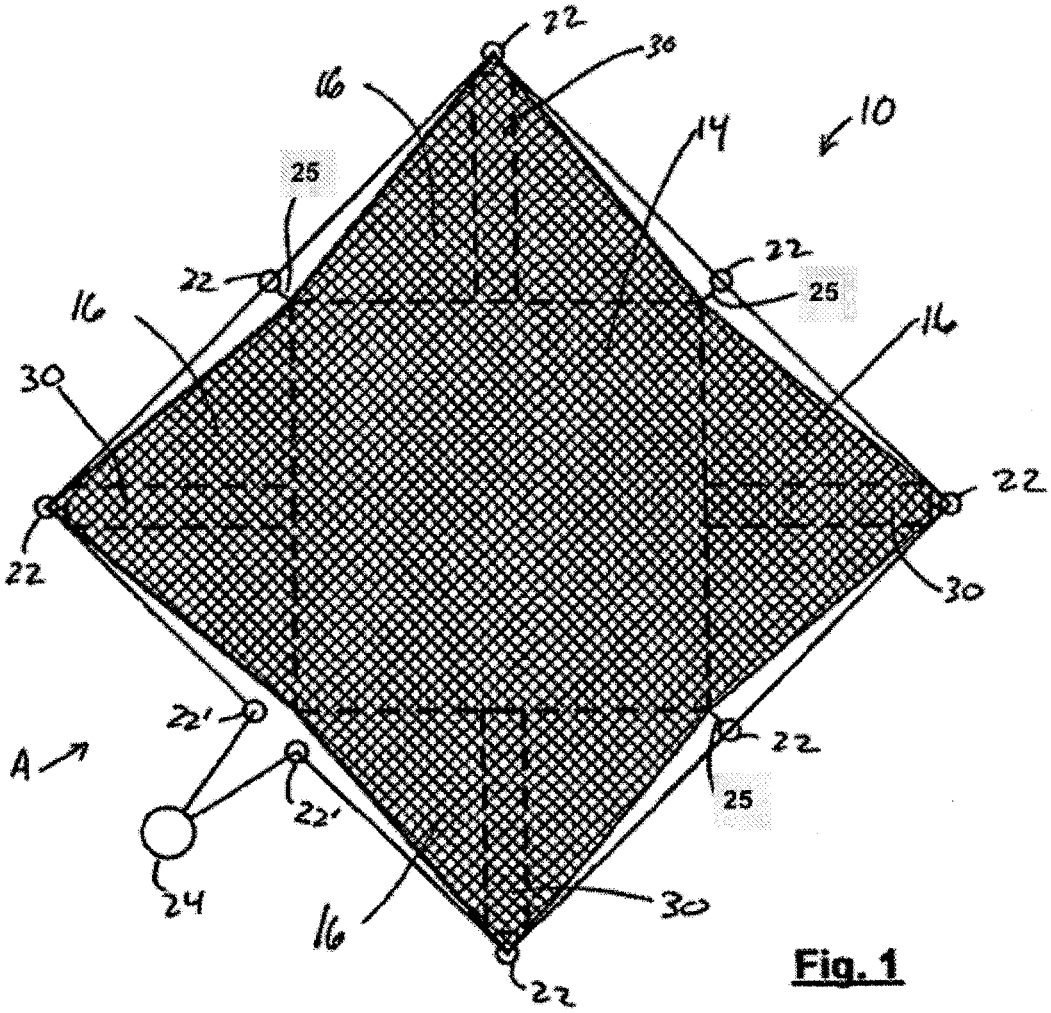
FIGS. 1 and 2 are diagrams of the leaf collection apparatus according to various embodiments of the present invention.

Various embodiments of the present invention are directed to an apparatus for transporting objects, particularly fallen leaves and/or other debris. With reference to FIG. 1, the apparatus 10 includes, according to various embodiments, a central collection section 12 and an enclosure system. The central collection section 12 may be made of a thin, light, durable material that is designed to lay flat on the ground such that fallen leaves and/or other debris or objects may be accumulated (such as by raking or blowing) onto the upper side of the central collection section 12. The central collection section 12 may be square or rectangular in shape, for example, and may be made from any of a number of possible materials, including plastic (e.g., tarpaulin), natural fibers (e.g., cotton) and synthetic materials (e.g., nylon).

According to one embodiment, the central collection section 12 may be made of a fine mesh netting such that it is not affected, or minimally affected, by wind. The mesh netting may be, for example, a high-density polyethylene monofilament knitted mesh or a woven PVC (polyester vinyl coated) mesh. The central collection section 12 may range in size from 10 to 100 square feet, for example. In addition, an interior portion (i.e., "floor portion") 14 of the central collection section 12 may be of different thickness (e.g., thicker) and/or material than a peripheral portion 16 of the central collection section 12. That is, for example, the floor portion 14 may comprise a mesh of a higher gauge material than the peripheral portion 16.

The enclosure system includes a rope 20 that is attached to the perimeter of the central collection section 12 by a number of grommets 22, for example. That is, the rope 20 may pass through the openings (or eyelets) of the grommets 22. The grommets 22 may be connected to the corners of the central collection section 12 and may be connected at intermittent positions along edges of the central collection section 12. The grommets 22 may be, for example, brass eyelets integrated in the central collection section 12 or may be connected to the central collection section 12 by an extension member 25 such that the grommets 22 are spaced apart from the central collection section 12, as shown in FIG. 1. The extension members 25 may be constructed, for example, of the same material as their associated grommets 22 or may be constructed of a different material. As used herein, the term "rope" refers to any type of long slender material, including cords, lines or twines having strands woven or twisted together, as well as plastic or rubber cords or tubes.

Figure 2:
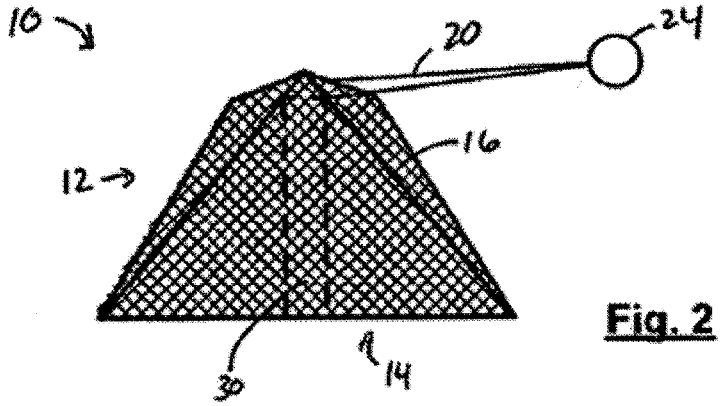

One side (A) of the central collection section 12 may have two grommets 22' in close proximity. A handle 24 may be attached to the rope 20 between the two grommets 22'. The handle 24 may be, for example, a ring (as shown in FIGS. 1 and 2) or a hook. Also, the handle 24 may be made of any suitable material, such as, for example, metal, wood or plastic. The handle 24 may be used by the operator to perform the pulling action to close up the central collection section 12 around the leaves/objects accumulated thereon. To initiate the pulling action, the operator may simply pull the handle 24.

In operation, when the central collection section 12 has a sufficient or desired number of leaves or other amount of debris thereon, an operator may pull on the handle 24. By the pulling action, the peripheral portion 16 of the central collection section 12 may be pulled up and over the floor portion 14 to thereby enclose the leaves or other objects on the central collection section 12, as shown in FIG. 2. The apparatus 10, including the enclosed central collection section 12, may then be hauled to a different location. There the leaves or other debris may be emptied from the central collection section 12 and the process may be repeated as needed.

In various embodiments, the apparatus 10 may include a number of stiffeners 30 connected to the peripheral portion 16 and/or the floor portion 14 of the central collection section 12 and that extend radially to the corners of the central collection section 12. The stiffeners 30 may facilitate enclosing of the central collection section 12 upon pulling of the rope 20. The stiffeners 30 may be made of a flexible material such as, for example, fiberglass or plastic, and may be positioned on the underside of the central collection section 12. In one embodiment, the underside of the central collection section 12 may include pockets (not shown) in which the stiffeners 30 are disposed.

As shown in FIG. 1, the stiffeners 30 may extend from radially inward from the edge (e.g., corners) of the central collection section 12 to the interior portion 14 of the central collection section 12. According to other embodiments, the stiffeners 30 may extend from the corners of the of the central collection portion 12 to the center of the interior portion 14.

While several embodiments of the present invention have been described herein, it should be apparent that various modifications, alterations and adaptations to those embodiments might occur to persons skilled in the art. For example, different materials may be used for some of the components of the apparatus than those described herein. It is therefore intended to cover all such modifications, alterations and adaptations without departing from the scope and spirit of the present invention as defined by the appended claims

What is claimed is:

1. A leaf collection apparatus, comprising:

a central collection section having an upper surface and a lower surface, the central collection section comprising an interior portion and a peripheral portion, wherein the peripheral portion extends from an outer edge of the interior portion to an outer edge of the peripheral portion, wherein the central collection section is for lying flat on the ground such that objects may be accumulated onto an upper surface of the interior portion of the central collection section, and wherein the thickness of the entire interior portion from the upper surface to the lower surface is greater than the thickness of the peripheral portion from the upper surface to the lower surface;

a plurality of pockets attached to the lower surface of the peripheral portion of the central collection section;

a plurality of straight, elongate stiffeners, wherein at least a portion of one stiffener is disposed in one of each of the plurality of pockets, wherein the stiffeners include a upper surface in contact with the lower side of the peripheral portion of the central collection section, and wherein a first end of each stiffener is adjacent to an outer edge of the lower side of the interior portion and a second end of each stiffer is adjacent to an outer edge of the peripheral portion, such that the stiffeners extend along the lower side of the peripheral portion from the outer edge of the interior portion to the outer edge of the peripheral portion; and an enclosure system connected to the outer edge of the peripheral portion of the central collection section for allowing an operator to enclose the interior portion with the peripheral portion of the central collection section, with the entire rectangular interior portion remaining flat on the ground, by raising the second ends of the stiffeners, wherein the enclosure system comprises a rope.

2. The leaf collection apparatus of claim 1, wherein the stiffeners comprise plastic.

3. The leaf collection apparatus of claim 1, wherein the interior portion of the central collection section is made of a different material than the peripheral portion of the central collection section.

4. The leaf collection apparatus of claim 1, wherein the central collection section comprises a polyethylene monofilament knitted mesh.

5. The apparatus of claim 2, wherein the interior portion of the central collection section is made of a different material than the peripheral portion of the central collection section.

6. The apparatus of claim 5, wherein the peripheral portion of the central collection section comprises a polyethylene monofilament knitted mesh.

7. The leaf collection apparatus of claim 1, wherein the enclosure system further comprises a handle connected to the rope.

8. The apparatus of claim 2, wherein the enclosure system further comprises a handle connected to the rope.

9. A leaf collection apparatus, comprising:

a central collection section having an upper surface and a lower surface, the central collection section comprising a rectangular interior portion and a peripheral portion, wherein the peripheral portion extends from an outer edge of the rectangular interior portion to an outer edge of the peripheral portion, wherein the central collection section is for lying flat on the ground such that objects may be accumulated onto an upper surface of the interior portion of the central collection section, and wherein the material of the interior portion is different from the material of the peripheral portion;

a plurality of pockets attached to the lower surface of the peripheral portion of the central collection section;

a plurality of straight, elongate stiffeners, wherein one stiffener is disposed in one of each of the plurality of pockets such that the stiffeners include an upper surface in contact with the lower side of the peripheral portion of the central collection section, and wherein a first end of each stiffener is adjacent to an outer edge of the lower side of the interior portion and a second end of each stiffer is adjacent to an outer edge of the peripheral portion, such that the stiffeners extend along the lower side of the peripheral portion from the outer edge of the interior portion to the outer edge of the peripheral portion; and an enclosure system connected to the outer edge of the peripheral portion of the central collection section for allowing an operator to enclose the interior portion with the peripheral portion of the central collection section, with the entire rectangular interior portion remaining flat on the ground, by raising the second ends of the stiffeners, wherein the enclosure system comprises a rope.

10. The apparatus of claim 9, wherein the interior portion comprises vinyl.

11. The apparatus of claim 9, wherein the interior portion comprises vinyl and the peripheral portion comprises mesh.

12. The leaf collection apparatus of claim 9, wherein the stiffeners comprise plastic.

13. The leaf collection apparatus of claim 9, wherein the enclosure system further comprises a handle connected to the rope.

* * * * *